US010787888B2

(12) United States Patent
Andersen et al.

(10) Patent No.: US 10,787,888 B2
(45) Date of Patent: Sep. 29, 2020

(54) DOWNHOLE EXPANSION TOOL AND METHOD FOR USE OF THE TOOL

(71) Applicant: Altus Intervention (Technologies) As, Stavanger (NO)

(72) Inventors: Kristian Andersen, Stavanger (NO); Rune Hansen, Sandnes (NO); Anders Gronnerod, Sandnes (NO)

(73) Assignee: Altus Intervention (Technologies) AS, Stavanger (NO)

( * ) Notice: Subject to any disclaimer, the term of this patent is extended or adjusted under 35 U.S.C. 154(b) by 24 days.

(21) Appl. No.: 16/340,208

(22) PCT Filed: Oct. 16, 2017

(86) PCT No.: PCT/NO2017/050267
§ 371 (c)(1),
(2) Date: Apr. 8, 2019

(87) PCT Pub. No.: WO2018/074934
PCT Pub. Date: Apr. 26, 2018

(65) Prior Publication Data

US 2020/0040684 A1 Feb. 6, 2020

(30) Foreign Application Priority Data

Oct. 19, 2016 (NO) ..... 20161669

(51) Int. Cl.
*E21B 43/10* (2006.01)
*E21B 29/10* (2006.01)

(52) U.S. Cl.
CPC ..... *E21B 43/105* (2013.01); *E21B 29/10* (2013.01)

(58) Field of Classification Search
CPC ..... E21B 43/105; E21B 29/10; E21B 43/10
See application file for complete search history.

(56) References Cited

U.S. PATENT DOCUMENTS 4,779,445 A * 10/1988 Rabe ..... B21D 39/04 29/283.5
4,789,268 A 12/1988 Yarnell
5,785,120 A 7/1998 Smalley et al.
6,454,493 B1 9/2002 Lohbeck
7,028,770 B2 * 4/2006 Smith, Jr. ..... E21B 43/105 166/206

(Continued)

FOREIGN PATENT DOCUMENTS

WO WO 2010/072751 A2 7/2010

*Primary Examiner* — Michael R Wills, III
(74) *Attorney, Agent, or Firm* — Gable Gotwals

(57) ABSTRACT

An expansion tool and method for expanding a tubing is disclosed. The expansion tool includes a rear portion, an opposite leading end and an expansion piston within the expansion tool. The expansion piston includes an expansion cone and radially movable expansion elements forming a circumferential expansion body. The rear portion is adapted for engaging a power source positioned at the rear portion. The expansion tool further includes a plurality of expansion arms surrounding the expansion piston. Each expansion arm is on an outer side provided with an expansion element, and a wedge portion between the expansion element and the expansion cone. The wedge portion abuts the expansion cone.

15 Claims, 5 Drawing Sheets

(56) References Cited

U.S. PATENT DOCUMENTS

| | | | | |
|---|---|---|---|---|
| 7,086,477 | B2 * | 8/2006 | Duggan | B21D 39/10 166/380 |
| 7,090,025 | B2 * | 8/2006 | Haugen | E21B 43/103 166/207 |
| 7,117,941 | B1 | 10/2006 | Gano et al. | |
| 8,746,028 | B2 * | 6/2014 | Duggan | C21D 7/04 166/380 |
| 2004/0163823 | A1 | 8/2004 | Trinder et al. | |
| 2004/0177953 | A1 | 9/2004 | Wubben | |
| 2006/0054330 | A1 * | 3/2006 | Ring | E21B 43/105 166/380 |

* cited by examiner

DOWNHOLE EXPANSION TOOL AND METHOD FOR USE OF THE TOOL

CROSS-REFERENCE TO RELATED APPLICATIONS

This United States application is the National Phase of PCT Application No. PCT/N02017/050267 filed 16 Oct. 2017, which claims priority to Norwegian Patent Application No. 20161669 filed 19 Oct. 2016, each of which is incorporated herein by reference.

BACKGROUND

The present invention regards an expansion tool which is positioned within a damaged tubing. In particular the tubing may be positioned within a petroleum well drilled in the ground. The tubing has a deformation which makes it impossible to enter and pass the deformed area with a tool. The deformation makes the tubing useless. The expansion tool comprises radially displaceable expansion elements. More particularly, the expansion tool is adapted to expand radially a small portion of the deformed area. Thereafter, in a series of steps, adjacent portions of the damaged area are expanded until the whole deformation is repaired.

Many known expansion tools have a fixed diameter. These are pushed axially through an indentation by brute force. This harms the inner surface of the tube and may harm the tubing itself. The expansion tool may become stuck. It is known to use a stroker to push such an expansion tool through the indentation.

Damages may occur to a petroleum well construction. By accident, a production tubing may in a portion be indented or constricted, known as a tubing dent. Such damages to the tubing may be unintentionally caused by heavy well intervention equipment such as snubbing and coil tubing. Such damages may also be caused by external compression forces. Small changes or shifts along a fault zone may also impact a tubing. Sometimes, dependent on the cause and on the extent of the damage, the damage may be repaired in situ by an expansion tool or by a swaging tool. Parts of devices within the production tubing may be damaged. Such a part may be a flow tube in a tubing retrievable down hole safety valve (DHSV) which may make the DHSV nonfunctional. The well must be shut down. The production tubing must be retrieved and the DHSV replaced. Thereafter the well must be completed. This is a time consuming and expensive operation.

It would be beneficial if the flow tube could be repaired in situ. However, a DHSV may be irreparable damaged by forcing a fixed diameter expansion tool of known type through the flow tube. A more gentle method would be to convert a damaged tubing retrievable DHSV to a functional wireline retrievable DHSV. This could be done by expanding the flow tube to substantially its original shape and diameter and install by a wireline operation a retrievable DHSV. This will give considerable savings and the down time of the well will be reduced.

The invention has for its object to remedy or to reduce at least one of the drawbacks of the prior art, or at least provide a useful alternative to prior art.

The object is achieved through features, which are specified in the description below and in the claims that follow.

SUMMARY

In a first aspect the invention relates more particularly to an expansion tool for expanding a tubing, the expansion tool comprises:

a rear portion;

an opposite leading end;

an expansion piston within the expansion tool, the expansion piston comprising an expansion cone; and radially movable expansion elements forming a circumferential expansion body, where the rear portion is adapted for engaging a power source, said power source is positioned at the rear portion, and the expansion tool further comprises:

a plurality of expansion arms surrounding the expansion piston, each expansion arm is on an outer side provided with an expansion element; and a wedge portion between the expansion element and the expansion cone, said wedge portion abutting the expansion cone.

The expansion tool is in particular adapted for expanding a tubing within a well, such as a petroleum well. The expansion elements are interchangeably connected to the expansion arm.

An outward front end surface and an outward rear end surface of the expansion element may be at an equal distance to a centre axis. The outward front end surface and the outward rear end surface may form a continuous outward expansion surface.

The expansion cone may taper towards the expansion tool's leading end with an angle "α" relative to a centre axis of the expansion tool.

Each expansion arm may extend forward from a holding sleeve to the expansion element. An arm extension may extend from the expansion element towards and into a guiding sleeve, said guiding sleeve being connected to a free end of the expansion piston at the expansion tool's leading end. Said arm extension may form an outer surface tapering towards the expansion tool's leading end. The outer surface may taper towards the expansion tool's leading end with an angle "α" relative to a centre axis of the expansion tool. An inside portion of the guiding sleeve may abut the outer surface of the arm extension.

A holding portion at the expansion arm's rear end may be locked axially and radially in a circumferential assembly groove in the holding sleeve by an adapter sleeve fitted on the outside and circumventing the expansion arm's rear end. The holding portion may, however, be displaced slightly relative to the holding sleeve as the holding portion may not be fixed to the holding sleeve or the adapter sleeve by means of a screw, bolt or other fastening means, such as a weld or a hinge. In an alternative embodiment the holding portion may be positioned in a recess in the in the holding sleeve and secured by the circumventing adapter sleeve. The expansion arms front ends are displaced radially outwards by the forward movement of the expansion piston. The expansion arms holding portion at the rear end may be locked in the radial direction by the adapter sleeve. Thus the expansion arms may be bent outwards without any distinct axis of rotation. The outward displacement of the expansion arms' front ends may create a tension in the expansion arms, and this tension may assist in an inward radial displacement of the expansion arms' front ends when the expansion piston is retracted towards the rear portion.

The wedge portion may widen towards the expansion tool's leading end. The wedge portion may widen with an angle "α" relative to a centre axis of the expansion tool.

The expansion cone may be provided with a plurality of axially oriented guiding grooves, and the wedge portion may be provided with an axially oriented guiding protrusion, and the guiding protrusion is complementary to one of the guiding grooves.

The arm extension portion may in a free end be provided with a guide pin; the guiding sleeve may be provided with a plurality of axially oriented guide slits; and each guide pin may be positioned in a respective guide slit.

The expansion tool may be provided with an inner release sleeve connected to the expansion arms, the inner release sleeve may be axially displaceable relative to an outer release sleeve at the expansion tool's rear portion, the outer release sleeve may be fastened to the inner release sleeve with at least one shear pin, and the inner release sleeve may be provided with a rim that abuts an internal emergency release shoulder in the outer release sleeve when the inner release sleeve is fully displaced relative to the outer release sleeve.

In a second aspect the invention relates more particularly to a method for expanding a tubing from within, where the method comprises the steps to:

a) provide an expansion tool with a circumferential expansion body, said expansion body comprising a plurality of peripheral expansion elements, the expansion elements are radially movable between a retracted position and an expanded position;

b) provide a power source and connect the power source to the expansion tool's rear portion;

c) provide a transportation means adapted to displace the expansion tool and the power source within the tubing;

d) displace the expansion body to a first portion of a deformation of the tubing;

e) activate the power source such that the expansion elements are displaced radially and are engaging the inner surface of the tubing;

f) displace radially and outwardly the expansion elements to a first intended radial distance;

g) displace radially and inwardly the expansion elements to a second intended radial distance which is less than the first radial distance; and h) retract the expansion tool, the power source and the transportation means out of the tubing.

The method may further comprise the steps after step g) and before step h):

$g_1$) displace axially the expansion body to a second portion of the deformation, said second portion being adjacent to the first portion;

$g_2$) repeat the steps e)-g); and $g_3$) optionally repeat the steps e)-$g_2$).

The method may further comprise before step h) the step of displacing the expansion elements to a third intended radial distance less than a fully expanded radial distance and run the expansion body through the entire length of the expanded and repaired deformation. The expansion body may be run through the entire length of the expanded and repaired deformation from the final expanded portion of the repaired deformation to the initial expanded portion of the repaired deformation.

In the following is described an example of a preferred embodiment illustrated in the accompanying drawings, wherein:

DETAILED DESCRIPTION

Figure 3:
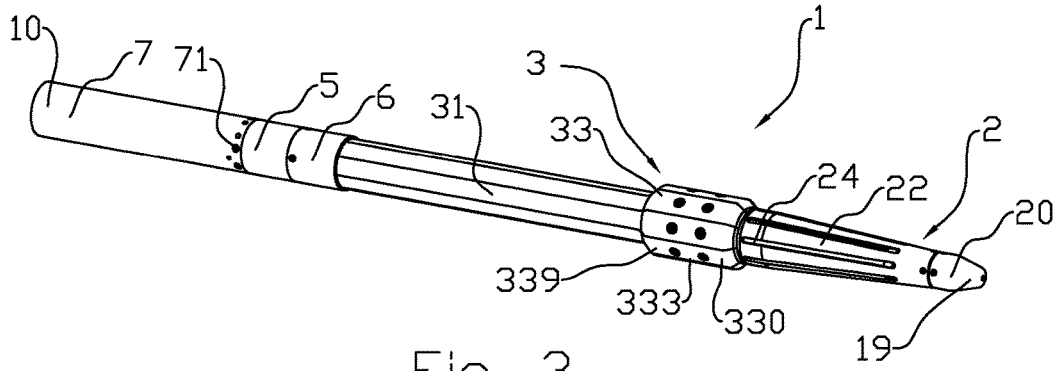
FIG. 3 shows in a different scale the expansion tool in a retracted position.
Figure 4:
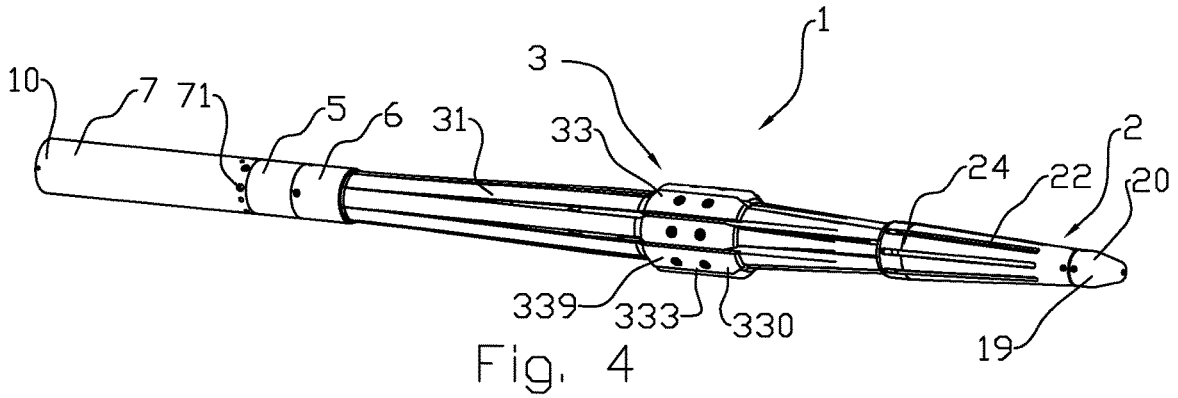
FIG. 4 shows in the same scale as FIG. 3 the expansion tool in a fully expanded position.
Figure 5:
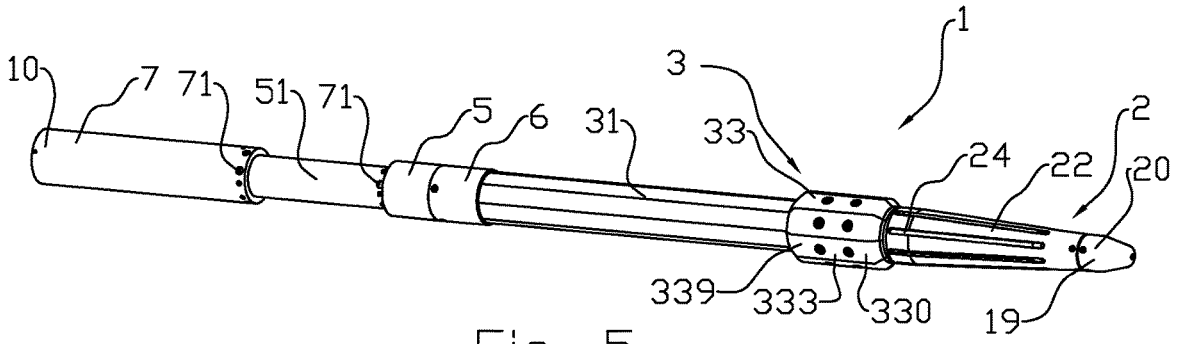
FIG. 5 shows in the same scale as FIG. 3 the expansion tool in an emergency retracted position.
Figure 7:
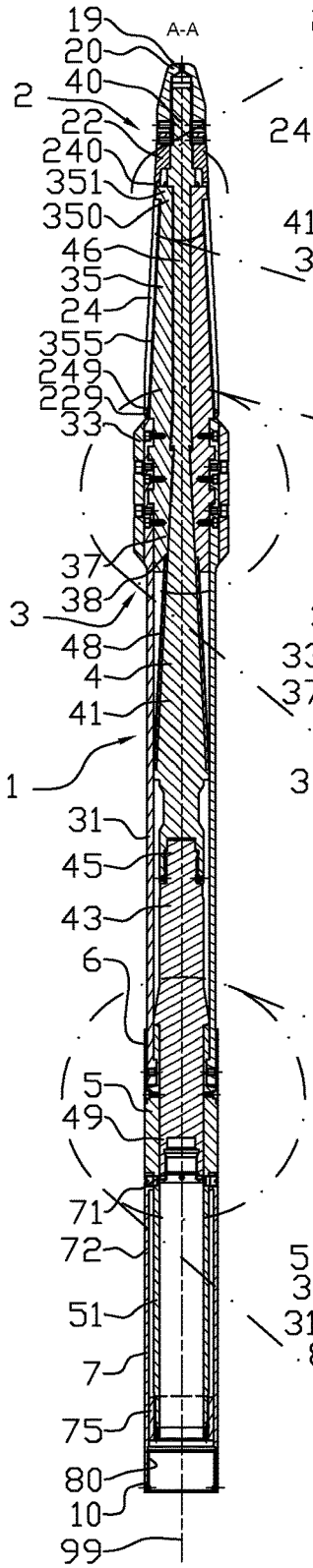
FIG. 7 shows in the same scale as FIG. 6 a cross section of the expansion tool along the line A-A.
Figure 12:
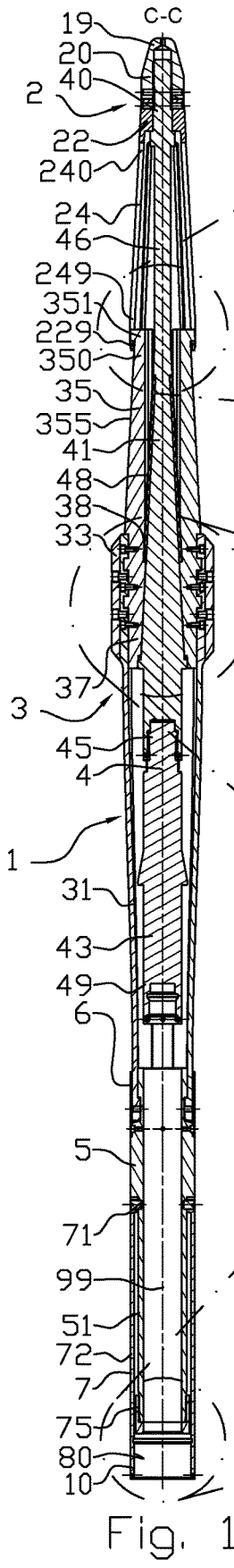
FIG. 12 shows in the same scale as FIG. 6 a cross section of the expansion tool in FIG. 11 along the line C-C.
Figure 17:
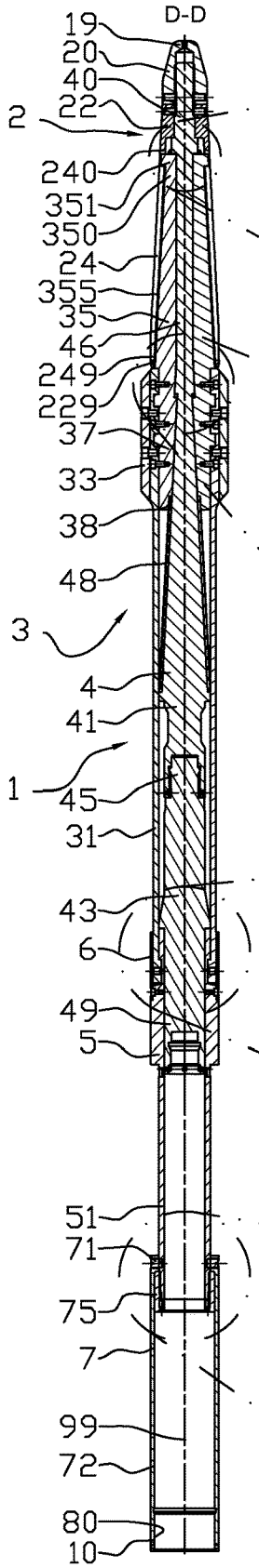
FIG. 17 shows in the same scale as FIG. 6 a cross section of the expansion tool in FIG. 16 along the line D-D.

In the drawings, the reference numeral 1 indicates an expansion tool for a tubing. The expansion tool 1 forms a rear portion 10 and a leading end 19. As seen in FIGS. 3-5 the expansion tool 1 comprises from the leading end 19 towards the rear portion 10, a bull nose 2 comprising a bull nose cap 20, an expansion body 3, a guiding sleeve 22 between the expansion body 3 and the leading end 19, axially extending expansion arms 31, an adapter sleeve 6, a holding sleeve 5, and an outer release sleeve 7. As shown in FIGS. 7, 12 and 17, the expansion tool 1 comprises further an axial displaceable expansion piston 4, and an inner release sleeve 51 connected to the holding sleeve 5.

In the description, the term front and front end means the leading end 19 of the expansion tool 1. Forward is in a direction towards the leading end 19. Backwards and rearwards is in a direction towards the rear portion 10. A tail and a tail end is at the rear portion 10.

Figure 1:
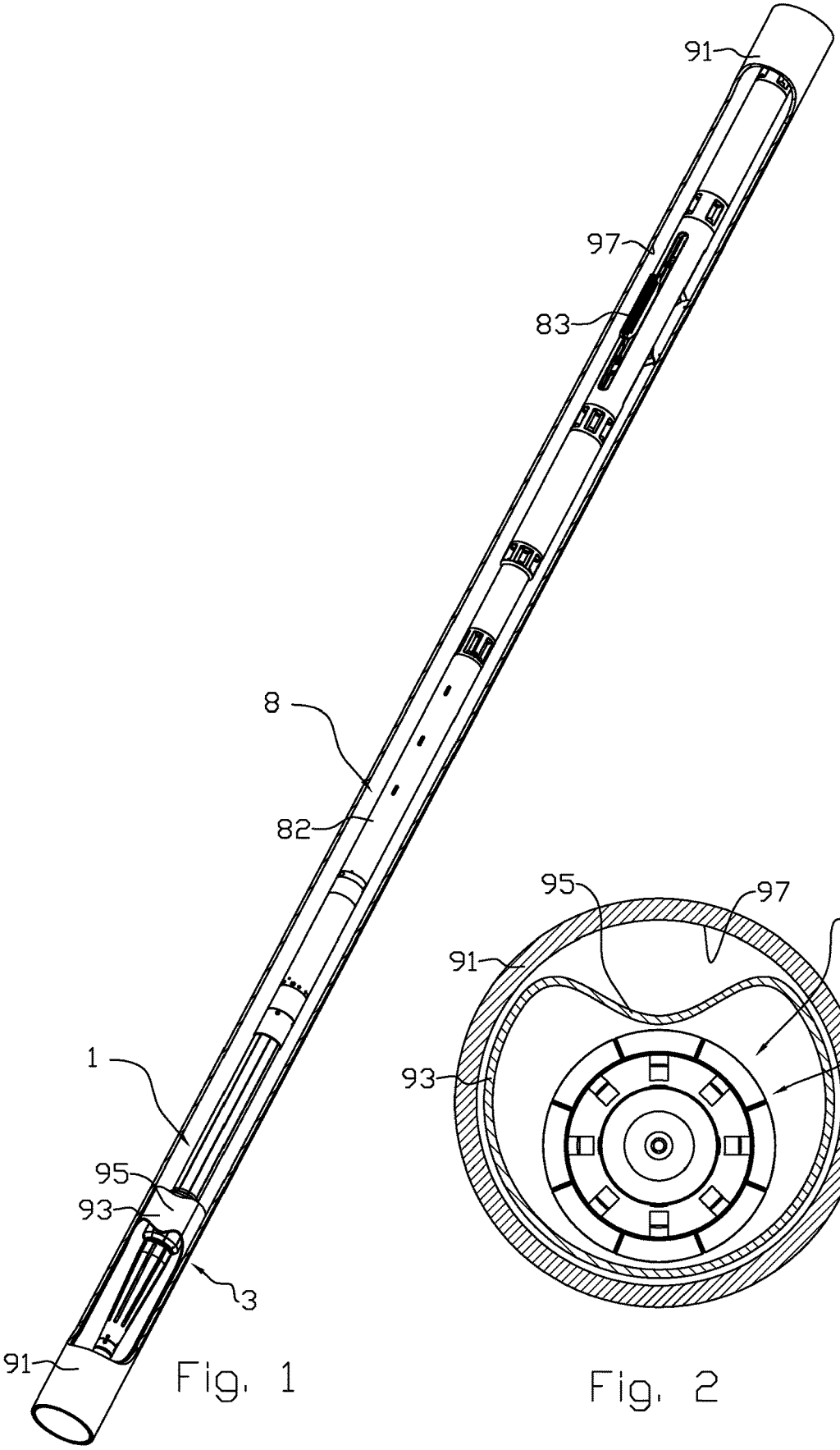
FIG. 1 shows in a perspective view an expansion tool in a retracted position and a stroker connected to the expansion tool, within a tubing with a damage.
Figure 2:
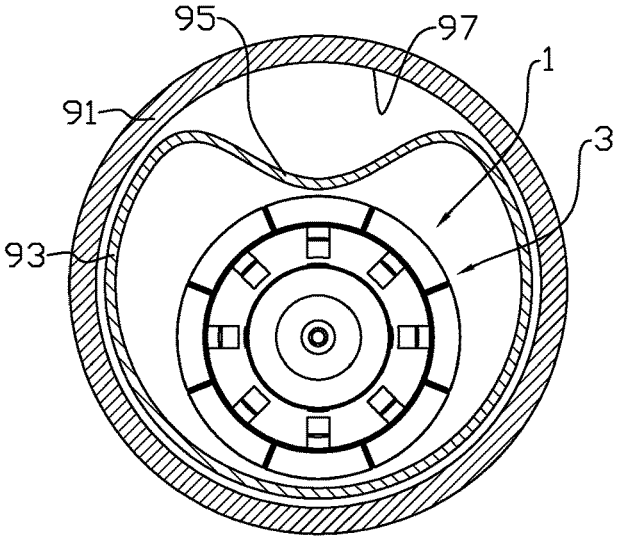
FIG. 2 shows in a larger scale a front view of the expansion tool within a damaged section of a tubing.

As seen in FIG. 1, the expansion tool 1 is connected to a power source 8. The power source is shown as a stroker 82. The stroker 82 is of a type known per se. The assembly of the stroker 82 and the expansion tool 1 is lowered within a tubing 91 by a wire line (not shown) in a manner known to the skilled person. The wire line provides electrical power to the power source 8. As an alternative the assembly may be displaced in a deviating or horizontal tubing 91 by a tractor (not shown). The tractor is connected to the wire line and receives energy from the wire line. In FIG. 1 it is shown that the assembly is lowered until the expansion body 3 is located at a damage 95 of a flow tube 93 within the tubing 91. The exact position of the damage 95 within the flow tube 93 has been located in advance in a manner known to the skilled person. The internal geometry of the damage 95 may also have been mapped in advance. The exact position of the expansion body 3 is also known to an operator. Optionally, the stroker 82 is secured to an internal wall 97 of the tubing 91 by activating the stroker's 82 slips 83.

Figure 10:
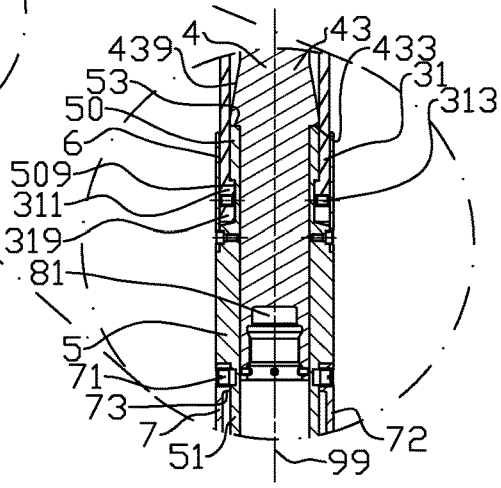
Figure 11:
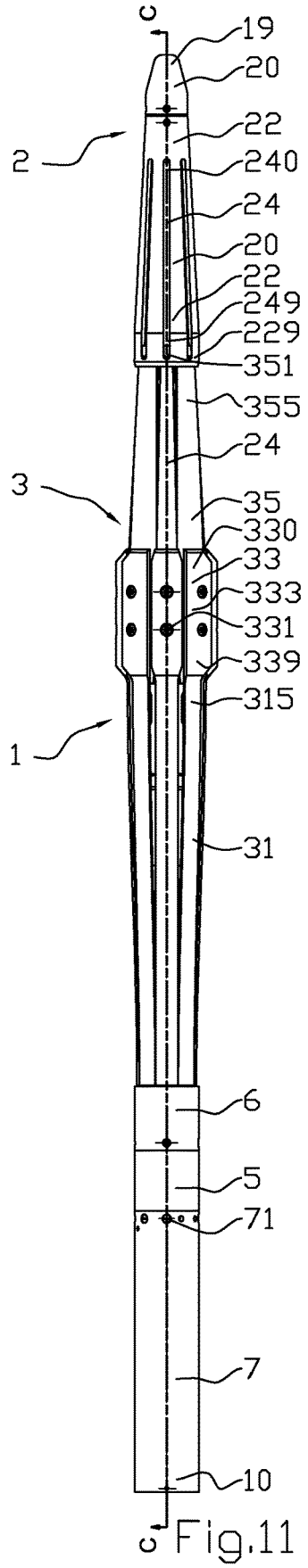
FIG. 11 shows in the same scale as FIG. 6 a side view of the expansion tool in a fully expanded position.
Figure 20:
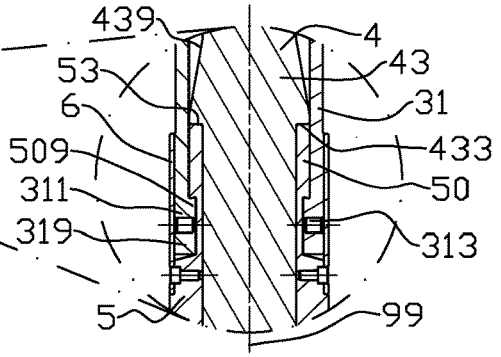

The holding sleeve 5 is at a front portion 50 provided with a circumferential assembly groove 509 as best seen in FIGS. 10 and 20. An expansion arm's 31 rear end 319 is provided with a holding portion 311 which fits complementary in the assembly groove 509. The adapter sleeve 6 covers the expansion arm's 31 rear end 319 on the outside. Thus the holding portion 311 is locked axially and radially in the circumferential assembly groove 509 by the adapter sleeve 6. The holding portion 311 may, however, be displaced slightly relative to the holding sleeve 5 as the holding portion 311 is not fixed to the holding sleeve 5 or the adapter sleeve 6 by means of a screw, bolt or other fastening means, such as a weld or a hinge. In an alternative embodiment the holding portion 311 is positioned in a recess (not shown) in the in the holding sleeve 5 and secured by the adapter sleeve 6.

Figure 6:
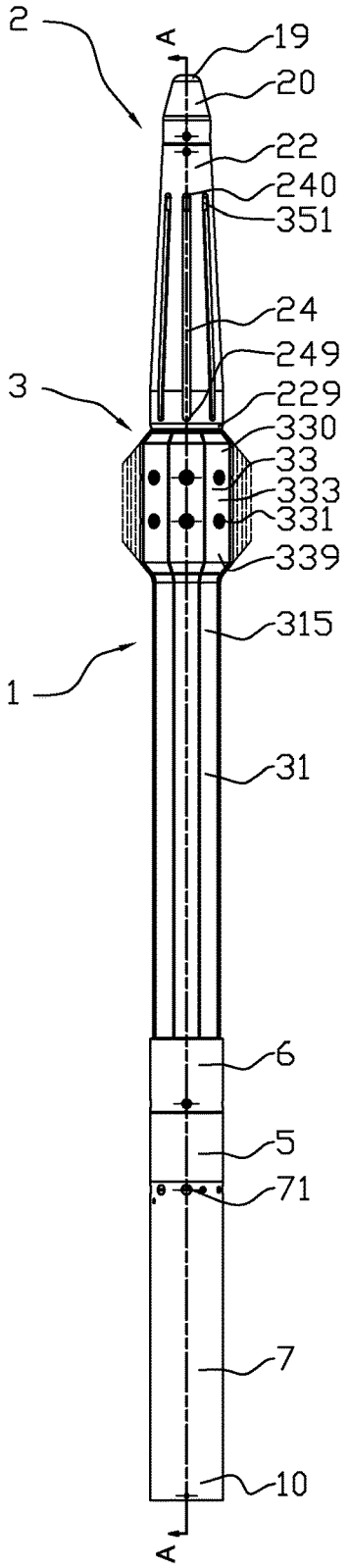
FIG. 6 shows in another scale a side view of the expansion tool in a retracted position.

The expansion arms 31 extend axially from the holding sleeve 5 towards the leading end 19. Each expansion arm 31 is on its outside 315 in a portion provided with an interchangeable expansion element 33. The expansion element 33 forms an outward front end surface 330 and an outward rear end surface 339. The outward front end surface 330 and the outward rear end surface 339 form a continuous outward expansion surface 333. In FIG. 6 it is shown with dashed lines the profile of increasing sized expansion elements 33. Each expansion element 33 is releasably fastened to a corresponding expansion arm 31 with screws 331. The expansion arm 31 is shown formed with a straight portion from the rear end portion 319 towards the expansion body 3. The width and thickness of the straight portion is substantially constant along the straight portion. The expansion arms 31 may be made of a strong material such as steel.

Figure 9:
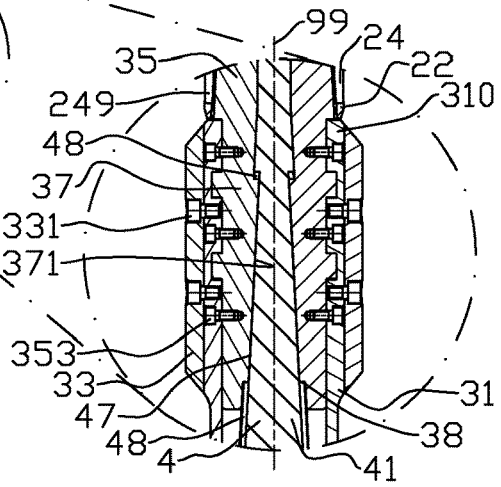
Figure 14:
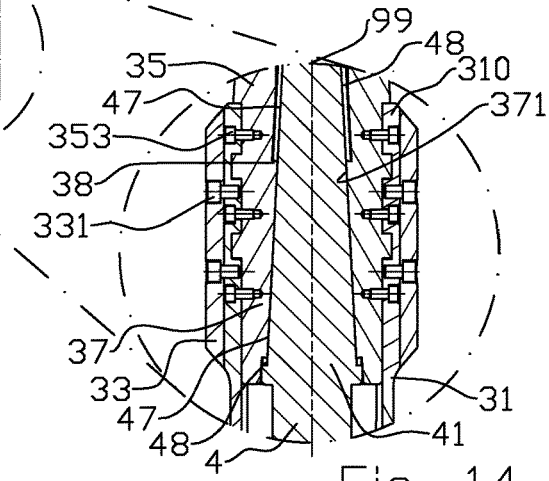
Figure 19:
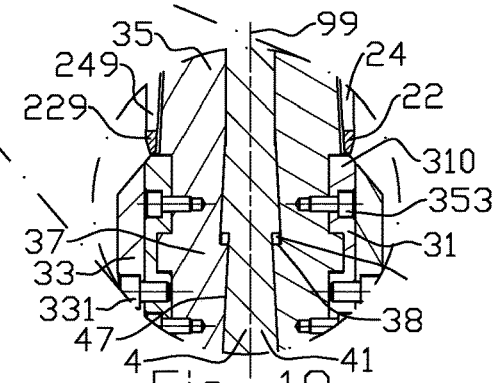

The expansion arm 31 forms a front end 310. In the figures each expansion arm 31 is shown extending past the expansion elements 33 between the expansion elements 33 and a centre axis 99. Each expansion arm 31 is shown connected to an arm extension 35 which extends from the rear portion of the expansion body 3 towards the leading end 19, as best seen in FIGS. 7, 12 and 17. The arm extension 35 is shown connected to the expansion arm 31 with screws 353, as best seen in FIGS. 9, 14 and 19. The arm extension 35 is at a front end 350 provided with a guide pin 351. The guide pin 351 points outward in a radial direction. The arm extension 35 is in the expansion body 3 portion provided with a wedge portion 37 provided with an inclined face 371 facing inward towards the centre axis 99, as best seen in FIGS. 9 and 14. The inclined face 371 tapers towards the rear portion 10. The arm extension 35 forms between the expansion body 3 and the front end 350 a straight side facing the centre axis 99. The opposite, outer side of the arm extension 35 is formed with an inclined face 355 tapering towards the leading end 19, as best seen in FIGS. 7, 11, 12 and 17. The inclined face 355 and the inclined face 371 both form an angle "α" with reference to the centre axis 99.

In the figures, the expansion arm 31 and the arm extension 35 are shown as two separate pieces with overlapping portions and joined together with screws 353. In an alternative embodiment the expansion arm 31 and the arm extension 35 are made of one piece of material. The function of the expansion arm 31 and the arm extension 35 is described in what follows, and the function is the same either the expansion arm 31 and the arm extension 35 are made of separate pieces or made of one piece of material. The arm extensions 35 may be made of a strong material such as steel.

Figure 8:
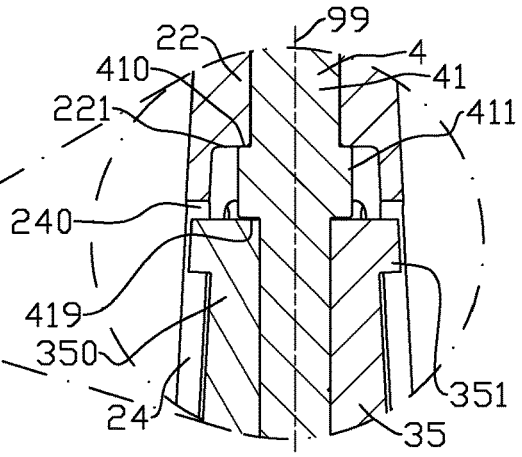
FIGS. 8-10 show enlarged portions of FIG. 7.
Figure 18:
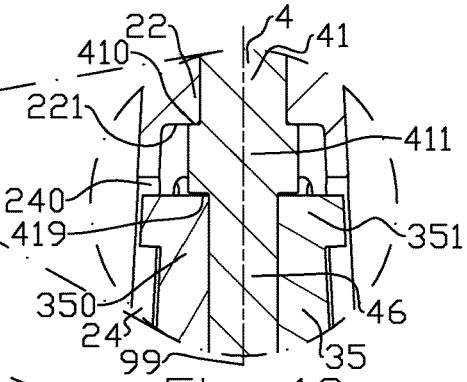
FIGS. 18-21 show enlarged portions of FIG. 17.

The axial displaceable expansion piston 4 is internally and centrally positioned within the expansion tool 1 along the centre axis 99. The expansion piston 4 forms a free end 40 at the leading end 19 and a piston rear end 49. The piston rear end 49 is positioned within the holding sleeve 5 when the expansion tool 1 is in its inactive, retracted position. The piston rear end 49 is provided with a connector 81 for a stroker organ (not shown). The free end 40 is firmly connected to the bull nose 2. The bull nose 2 is shown comprising the bull nose cap 20 at the end of the leading end 19. The free end 40 is further firmly connected to the guiding sleeve 22 adjacent the bull nose cap 20. The guiding sleeve 22 is formed as a frustum with the narrow part facing the leading end 19 and the wide part facing the expansion body 3. A rear portion of the internal face of the guiding sleeve 22 forms an angel "α" with respect to the central axis 99. The guiding sleeve 22 is provided with a plurality of guide slits 24. Each guide slit 24 forms a nose end 240 and a tail end 249. In the drawings the guide slit 24 is shown as a longitudinal through opening in the wall of the guiding sleeve 22. The guide slit 24 is complementary to the guide pin 351. The free end 40 is provided with a dog 411 which forms a widening of a straight portion 46 of the expansion piston 4. The dog 411 is provided with a front dog shoulder 410 which abuts an internal contact face 221 in the front portion of the guiding sleeve 22. The dog 411 is further provided with a rear dog shoulder 419, as best seen in FIGS. 8 and 18.

In the figures the expansion piston 4 is shown as comprising a front piston body 41 and a piston connector 43. The front piston body 41 and the piston connector 43 is connected at a piston joint 45. In an alternative embodiment, the expansion piston 4 may be formed as one piece of material.

The front piston body 41 comprises an expansion cone 47 that tapers towards the free end 40. When the expansion tool 1 is in the inactive, retracted state, the slimmest portion of the expansion cone 47 is located at the front end of the expansion body 3, as shown in FIGS. 7 and 9. The surface of the expansion cone 47 forms an angel "α" with respect to the central axis 99.

The straight portion 46 extends between the expansion cone 47 and the dog 411. The straight portion 46 has a substantially constant diameter.

The expansion cone 47 is optionally provided with a plurality of axially oriented expansion grooves 48. The number of expansion grooves 48 corresponds with the number of arm extensions 35. Each arm extension 35 is optionally provided with a guiding protrusion 38 which projects from the inclined face 371. The guiding protrusion 38 fits complementary in the expansion groove 48. The expansion groove 48 extends from the rear portion of the expansion cone 47 to the front portion of the expansion cone 47.

The piston connector 43 is in a mid-portion provided with an assembly cone 439 which tapers towards the free end 40. At a rear end the assembly cone 439 forms a cone shoulder 433. The cone shoulder 433 abuts a rim 53 of the holding sleeve's 5 front portion 50 when the expansion tool 1 is in the retracted position as shown in FIGS. 7, 10 and 14. The widest diameter of the assembly cone 439 corresponds to the outer diameter of the front portion 50.

Figure 15:
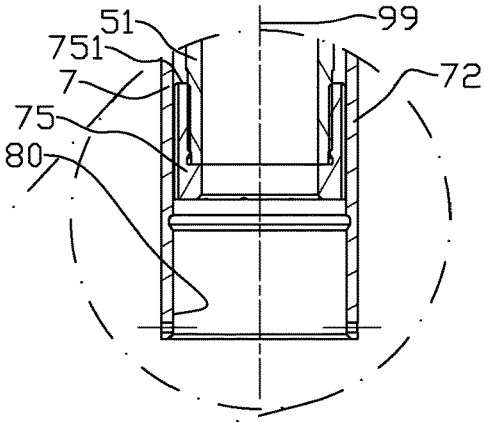
Figure 16:
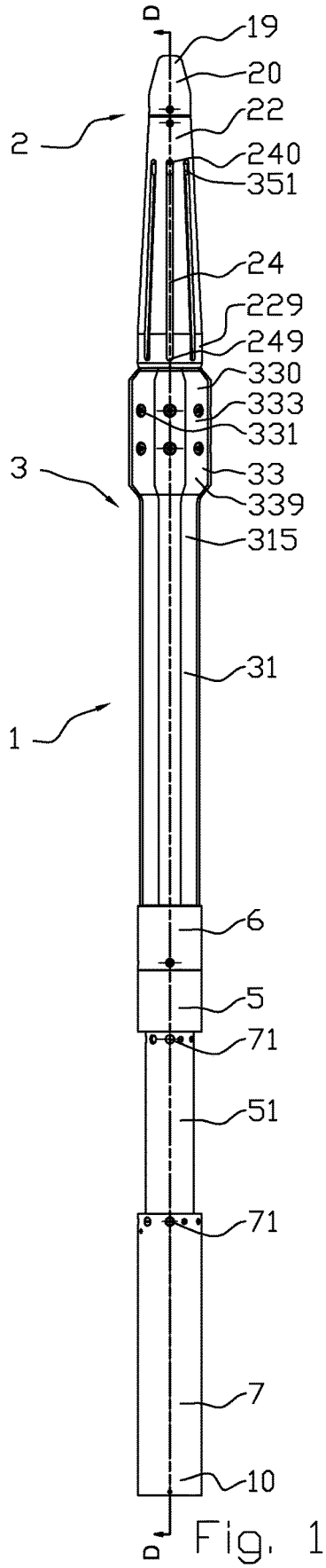
FIG. 16 shows in the same scale as FIG. 6 a side view of the expansion tool in an emergency retracted position.

The inner release sleeve 51 is at a rear end shown provided with a fixed stop sleeve 75 around the circumference of the inner release sleeve 51. The stop sleeve 75 forms a stop sleeve rim 751 facing towards the leading end 19 as shown in FIG. 15.

The outer release sleeve 7 surrounds the inner release sleeve 51 when the expansion tool 1 is in both its inactive, retracted position as shown in FIG. 7 and in its active, expanded position as shown in FIG. 12. The release sleeve 7 is axially displaceable relative to the release sleeve 51, and the release sleeve 7 is fastened to the holding sleeve 5 with at least one shear pin 71. A plurality of shear pins 71 are shown in the figures. The release sleeve's 7 wall 72 is at the front end portion thicker than the remaining portion of the wall 72. The thicker wall portion forms a support for the shear pins 71. The thicker wall portion forms a release shoulder 73 which faces the rear portion 10, see FIG. 10.

The wall 72 is at a rear end formed with an internal stroker connector 80 as shown in FIGS. 7, 12 and 17.

The expansion arms 31 holding portions 311 are guided into the assembly groove 509 by sliding each holding portion 311 over the assembly cone 439, further rearwards over the outer surface of the front portion 50 and into the assembly groove 509. When all expansion arms 31 are correctly positioned, the adapter sleeve 6 is displaced rearwardly over the expansion arms 31 to encompass the rear ends 319. The adapter sleeve 6 is releasable fastened to the holding sleeve 5 with screws. The expansion arms 31 are dismantled by first releasing the adapter sleeve 6 and displace the adapter sleeve 6 forwardly over the expansion arms 31. By turning a dismantling screw 313, see FIGS. 10 and 20, the holding portion 311 is lifted out of the assembly groove 509 and the expansion arm 31 is displaced forwardly over the outer surface of the front portion 50 and the assembly cone 439.

The guiding sleeve 22 surrounds the arm extensions 35 from the guide pins 351 to the expansion arm's 31 front end 310, when the expansion tool 1 is in its inactive, retracted state as seen in FIG. 7. In the inactive, retracted state, each guide pin 351 is positioned at the nose end 240 of the respective guide slit 24.

The expansion tool 1 is connected to the power source 8 such as a stroker 82 at the stroker connector 80. The expansion piston 4 is connected to the stroker's stroking organ (not shown) at the stroker organ connector 81. Activation of the stroker organ in an axially direction towards the leading end 19 will displace the expansion piston 4 axially forwards towards the leading end 19 as well. The cap 20 and the guiding sleeve 22 are both fixed to the free end 40 and will also be displaced axially with the same speed as the expansion piston 4. The outer sleeve 7, the holding sleeve 5, the expansion arms 31, the expansion body 3 and the arm extensions 35 are all fixed to the stroker 82 and will not be displaced axially. The guide pins 351 are displaced axially within the guide slits 24 from the nose end 240 towards the tail end 249 of each of the guide slits 24 when the guiding sleeve 22 is displaced forward.

As the expansion piston 4 is displaced axially forwards, the expansion cone 47 abuts the wedge portions 37 such that the wedge portions 37, the expansion arms 31 front ends 310, the arm extensions 35 rear ends and the expansion elements 33 are displaced radially outwards. This is best seen in FIGS. 4, 12-14.

The expansion cone 47, the inclined face 371 of the wedge portion 37, the inclined face 355 of outer side of the arm extension 35, and the internal face of the guiding sleeve 22 all form an angle "α" with reference to the centre axis 99. As a result, the expansion elements 33 are displaced radially outwards with the same increase in radius from the centre axis 99 at the front end surface 330 and at the rear end surface 339 of the expansion elements 33. In other words, the outer surfaces 333 of the expansion elements 33 are parallel to the centre axis 99 when the expansion tool 1 is in the retracted state, when the expansion tool 1 is in the fully expanded state and when the expansion tool 1 is between the retracted state and the fully expanded state.

The axial displacement distance of the stroker organ is precisely determined by known means such as a stroker position controller. The radial displacement distance of the expansion elements 33 is an exact function of the stroker organ's displacement distance.

Figure 13:
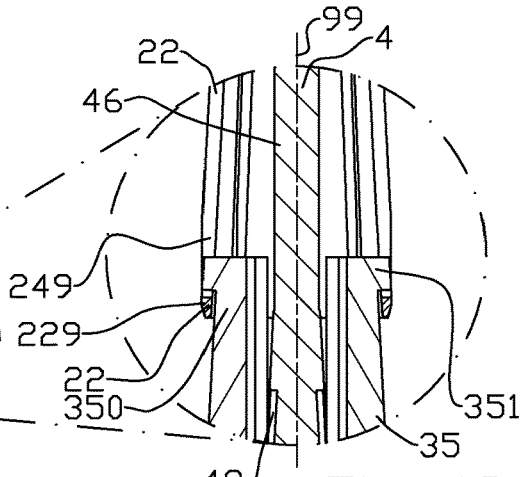
FIGS. 13-15 show enlarged portions of FIG. 12.

The maximum axial displacement distance of the stroker organ is determined by the stroker's construction. An internal stop shoulder (not shown) within the stroker impede further axial forward displacement. The length of each guide slit 24 is longer than the travel distance of the guide pin 351 as shown in FIGS. 12 and 13. In addition the length of each guiding groove 48 is adapted to the guiding protrusion 38 such that the guiding protrusion 38 will not abut the front end and the tail end of the guiding groove 48, as shown in FIGS. 7, 9, 12 and 14.

The guiding protrusions 38 positioned in the guiding grooves 48 secure that the expansion arms 31, the arm extensions 35, the wedge portions 37 and the expansion elements 33 are displaced strictly in the radial direction.

The expansion arms 31 front ends 310 are displaced radially outwards by the forward movement of the expansion piston 4. The expansion arms 31 holding portion 311 at the rear end 319 are locked in the radial direction by the adapter sleeve 6. Thus the expansion arms 31 are bent outwards without any distinct axis of rotation. The outward displacement of the expansion arms 31 front ends 310 creates a tension in the expansion arms 31, and this tension will assist in an inward radial displacement of the expansion arms 31 when the expansion piston 4 is retracted towards the rear portion 10.

The stroker 82 and the expansion tool 1 is positioned in a tubing 91 in which a tube portion has been constricted or indented due to a damage 95. The stroker 82 and the expansion tool 1 may be positioned by a wire line or by a wire line operated tractor as known in the art. When the expansion body 3 is positioned in the upper end of the damage 95, i.e. the end closest to the surface opening of the tubing 91, the stroker 82 may optionally be anchored to the internal tube wall 97 by slips 83, as known in the art. The stroker organ is activated, the expansion piston 4 is displaced axially while the expansion elements 33 are displaced radially and forces the constricted tube wall radially outwards. The expansion elements 33 are not displaced axially when they are displaced radially. The expansion piston 4 may be displaced axially to a desired position, possibly to its maximum axially displacement, and the expansion elements 33 may consequently be displaced radially to a desired radial position, possibly to their maximum radial displacement. Thereafter, the expansion piston 4 is retracted rearwards to its passive position by the stroker organ.

The guide sleeve 22 is fixed to the expansion piston 4. When the expansion piston 4 is retracted rearwards, the guide sleeve 22 is displaced rearwards towards the expansion body 3. A rear end portion 229 of the guide sleeve 22 abuts the inclined faces 355 at the outside of the arm extensions 35 and will in a gliding manner force the arm extensions 35 and thereby the expansion arms 31 and the expansion elements 33 inwards towards the centre axis 99 when the guide sleeve 22 is displaced towards the expansion body 3.

When the expansion tool 1 is in its retracted position, the slips 83 are released, the stroker 82 is slightly displaced further into the damage 95 in a repair direction, and the method is repeated. The displacement in the repair direction may be equal to the length of the expansion elements 33, or the displacement may be shorter. The method is repeated until the expansion body 3 has been displaced completely through the damage 95.

Optionally the expansion elements 33 may finally be radially displaced to a position where the external circumference of expansion elements 33 is somewhat less than the created internal free diameter of the repaired, or partly repaired, damaged tube portion. The stroker 82 and the expansion tool 1 are withdrawn and the expansion elements 33 pass the damaged tube portion in the opposite direction of the repair direction. Thereby it is checked that there is free passage through the damage 95 for the expansion body 3.

The stroker 82 and the expansion tool 1 are withdrawn to the surface. If necessary, the expansion elements 33 are replaced with other expansion elements 33 with a larger thickness as shown in FIG. 6. The external circumference of the expansion body 3 thus becomes larger. The external circumference of the expansion body 3 may be larger than the external circumference of the holding sleeve 5, or the adapter sleeve 6, or the release sleeve 7, as shown in FIG. 6. The external circumference of the holding sleeve 5, the adapter sleeve 6, and the release sleeve 7 may the same. The method is then repeated, if necessary several times with further replacements of thicker expansion elements 33. A final check is performed with the expansion elements 33 displaced radially to somewhat less than the final internal free diameter of the tube portion, which is now without the damage 95.

The method allows for a gentle repair of a damaged portion of a tube 93. Brute force in the axial direction of the tube 93 is completely eliminated. The tube 93 is not subject to any torsion from the expansion tool 1.

Figure 21:
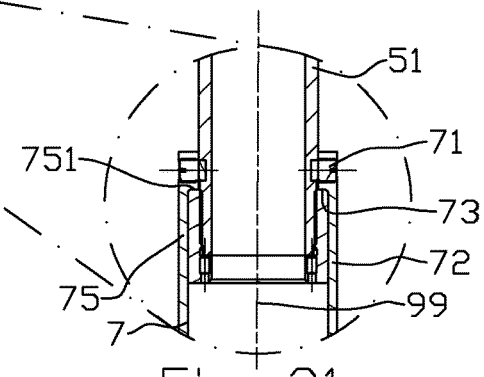

In case the stroker 82 is subject to a failure, the stroker organ may be locked in an active position without any means to retract the stroker organ towards the rear portion 10. The expansion cone 47 will press the expansion elements 33 towards the inside of the tubing 91 and the expansion body 3 will act as an anchor that cannot be released. In such a case the expansion tool 1 is released by an emergency procedure. The stroker 82 is pulled rearwards until the shear pins 71 break. The outer release sleeve 7 is pulled rearward relative to the inner release sleeve 51, as shown in FIGS. 5, 17 and 21. The outer release sleeve 7 is pulled rearward until the stop sleeve rim 751 abuts the release shoulder 73. The cone shoulder 433 will in addition abut the rim 53 of the holding sleeve front portion 50 as shown in FIG. 20. The stroker organ will keep its relative position to the stroker 82. However, the stroker 82 and the outer release sleeve 7 is displaced axially relative to the expansion body 3. The expansion piston 4 is fixed to the stroker organ and will thus also be displaced axially relative to the expansion body 3. The expansion cone 47 will no longer support the wedge portions 37 and the expansion elements 33 are free to move towards the centre axis 99. The guiding sleeve 22 is displaced together with the expansion piston 4. The rear end portion 229 of the guide sleeve 22 abuts the inclined faces 355 at the outside of the arm extensions 35 and will in a gliding manner force the arm extensions 35 and thereby the expansion arms 31 and the expansion elements 33 inwards towards the centre axis 99. The expansion tool 1 is thereby released and the stroker 82 and the expansion tool 1 can be withdrawn to the surface for repair. The stroker 82 may be pulled rearwards by jarring.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "α" or "an" preceding an element does not exclude the presence of a plurality of such elements.

The mere fact that certain measures are recited in mutually different dependent claims does not indicate that a combination of these measures cannot be used to advantage.

The invention claimed is:

1. Expansion tool for expanding a tubing, the expansion tool comprises: a rear portion; an opposite leading end; an expansion piston within the expansion tool, the expansion piston comprising an expansion cone; and radially movable expansion elements forming a circumferential expansion body, the rear portion is adapted for engaging a power source, said power source is positioned at the rear portion; a plurality of expansion arms surrounding the expansion piston, each expansion arm is on an outer side provided with an expansion element forming an outward front end surface and an outward rear end surface, and wherein and the outward front end surface and the outward rear end surface are at an equal distance to a centre axis of the expansion tool; and a wedge portion between the expansion element and the expansion cone, said wedge portion being provided with an inclined face, said inclined face abutting the expansion cone.

2. The expansion tool according to claim 1, where the expansion cone tapers towards the expansion tool's leading end with an angle ".alpha." relative to the centre axis of the expansion tool.

3. The expansion tool according to claim 1, wherein each expansion arm extends forward from a holding sleeve to the expansion element.

4. The expansion tool according to claim 1, wherein an arm extension extends from the expansion element towards and into a guiding sleeve, said guiding sleeve being connected to a free end of the expansion piston at the expansion tool's leading end.

5. The expansion tool according to claim 4, where said arm extension forms an outer surface tapering towards the expansion tool's leading end.

6. The expansion tool according to claim 5, wherein the outer surface tapers towards the expansion tool's leading end with an angle ".alpha." relative to the centre axis of the expansion tool.

7. The expansion tool according to claim 5, where an inside portion of the guiding sleeve abuts the outer surface of the arm extension.

8. The expansion tool according to claim 4, wherein the arm extension in a free end is provided with a guide pin; the guiding sleeve is provided with a plurality of axially oriented guide slits; and each guide pin is positioned in a respective guide slit.

9. The expansion tool according to claim 1, wherein the wedge portion is widening towards the expansion tool's leading end.

10. The expansion tool according to claim 9, where the wedge portion is widening with an angle ".alpha." relative to the centre axis of the expansion tool.

11. The expansion tool according to claim 1, wherein the expansion cone is provided with a plurality of axially oriented guiding grooves, and the wedge portion is provided with an axially oriented guiding protrusion, and the guiding protrusion is complementary to one of the guiding grooves.

12. The expansion tool according to claim 1, wherein the expansion tool is provided with an inner release sleeve connected to the expansion arms, the inner release sleeve is axially displaceable relative to an outer release sleeve at the expansion tool's rear portion, the outer release sleeve is fastened to the inner release sleeve with at least one shear pin, and the inner release sleeve is provided with a rim that abuts an internal emergency release shoulder in the outer release sleeve when the inner release sleeve is fully displaced relative to the outer release sleeve.

13. Method for expanding a tubing from within, characterised in that the method comprises the steps to: a) provide an expansion tool with a circumferential expansion body, said expansion body comprising a plurality of peripheral expansion elements, the expansion elements are radially movable between a retracted position and an expanded position; b) provide a power source and connect the power source to the expansion tool's rear portion; c) provide a transportation means adapted to displace the expansion tool and the power source within the tubing; d) displace the expansion body to a first portion of a deformation of the tubing; e) activate the power source such that the expansion elements are displaced radially and are engaging the inner surface of the tubing; f) displace radially and outwardly the expansion elements to a first intended radial distance; g) displace radially and inwardly the expansion elements to a second intended radial distance which is less than the first radial distance; h) retract the expansion tool, the power source and the transportation means out of the tubing; and wherein the expansion tool comprising: an opposite leading end; an expansion piston within the expansion tool and comprising an expansion cone; radially movable expansion elements forming a circumferential expansion body; a plurality of expansion arms surrounding the expansion piston, each expansion arm is on an outer side provided with the expansion element forming an outward front end surface and an outward rear end surface, and wherein and the outward front end surface and the outward rear end surface are at an equal distance to a centre axis of the expansion tool; and a wedge portion between the expansion element and the expansion cone, said wedge portion being provided with an inclined face, said inclined face abutting the expansion cone.

14. Method according to claim 13, where the method further comprises the steps after step g and before step h: $g_1$) displace axially the expansion body to a second portion of the deformation, said second portion being adjacent to the first portion; $g_2$) repeat the steps e-g; and $g_3$) optionally repeat the steps e-$g_2$.

15. Method according to claim 13, where the method further comprises before step h) the step of displacing the expansion elements to a third intended radial distance less than a fully expanded radial distance and run the expansion body through the entire length of the expanded deformation.

* * * * *